US012668756B2

(12) United States Patent
McCune et al.

(10) Patent No.: US 12,668,756 B2
(45) Date of Patent: Jun. 30, 2026

(54) GELLING AGENT FOR CALCIUM SULFONATE GREASES

(71) Applicant: The Lubrizol Corporation, Wickliffe, OH (US)

(72) Inventors: Devon K. McCune, Lyndhurst, OH (US); Gareth Fish, Munson Township, OH (US); Robert Douglas Dura, Broadview Heights, OH (US)

(73) Assignee: The Lubrizol Corporation, Wickcliff, OH (US)

( * ) Notice: Subject to any disclaimer, the term of this patent is extended or adjusted under 35 U.S.C. 154(b) by 0 days.

(21) Appl. No.: 19/107,803

(22) PCT Filed: Aug. 15, 2023

(86) PCT No.: PCT/IB2023/058207

§ 371 (c)(1),
(2) Date: Feb. 28, 2025

(87) PCT Pub. No.: WO2024/047447

PCT Pub. Date: Mar. 7, 2024

(65) Prior Publication Data

US 2025/0368915 A1 Dec. 4, 2025

Related U.S. Application Data

(60) Provisional application No. 63/402,994, filed on Sep. 1, 2022.

(51) Int. Cl.

| | |
|---|---|
| ***C10M 135/10*** | (2006.01) |
| ***C10M 115/04*** | (2006.01) |
| ***C10M 139/00*** | (2006.01) |
| ***C10M 177/00*** | (2006.01) |
| *C10N 30/00* | (2006.01) |
| *C10N 50/10* | (2006.01) |
| *C10N 70/00* | (2006.01) |

(52) U.S. Cl.

CPC ..... *C10M 135/10* (2013.01); *C10M 115/04* (2013.01); *C10M 139/00* (2013.01); *C10M 177/00* (2013.01); *C10M 2207/022* (2013.01); *C10M 2219/046* (2013.01); *C10M 2227/06* (2013.01); *C10N 2030/52* (2020.05); *C10N 2050/10* (2013.01); *C10N 2070/00* (2013.01)

(58) Field of Classification Search

CPC ..... C10M 135/10; C10M 115/04; C10M 139/00; C10M 177/00; C10M 2207/022; C10M 2219/046; C10M 2227/06; C10M 2203/1025; C10M 2203/1085; C10M 121/04; C10M 115/10; C10M 2219/0466; C10N 2030/52; C10N 2050/10; C10N 2070/00; C10N 2030/62

See application file for complete search history.

(56) References Cited

U.S. PATENT DOCUMENTS

| | | | | |
|---|---|---|---|---|
| 3,242,079 | A * | 3/1966 | McMillen | C10M 159/20 508/393 |
| 3,661,622 | A | 5/1972 | Rogers | |
| 3,671,012 | A | 6/1972 | Scott et al. | |
| 3,714,042 | A | 1/1973 | Greenough | |
| 3,746,643 | A | 7/1973 | Rogers | |
| 3,816,310 | A | 6/1974 | Hunt | |
| 4,560,489 | A | 12/1985 | Muir et al. | |
| 5,126,062 | A * | 6/1992 | Barnes | C10M 169/06 508/180 |
| 5,308,514 | A | 5/1994 | Olson et al. | |
| 5,338,467 | A | 8/1994 | Olson et al. | |
| 7,285,516 | B2 | 10/2007 | Carrick et al. | |
| 9,976,101 | B2 | 5/2018 | Waynick | |
| 2005/0054541 | A1 | 3/2005 | Zhang et al. | |
| 2010/0197536 | A1 | 8/2010 | Mosier et al. | |
| 2012/0101017 | A1 | 4/2012 | Duggal | |
| 2013/0109602 | A1* | 5/2013 | Waynick | C10M 115/10 508/180 |

FOREIGN PATENT DOCUMENTS

| | | | |
|---|---|---|---|
| CN | 108463542 | * | 8/2018 |
| CN | 108473910 | * | 8/2018 |
| CN | 113637515 | A | 11/2021 |
| WO | WO2008147704 | A1 | 12/2008 |
| WO | WO2017119999 | A1 | 7/2017 |

OTHER PUBLICATIONS

Sniderman, Debbie: "Calcium sulfonate complex greases," Tribology & Lubrication Technology, pp. 28-39 (2016).

* cited by examiner

*Primary Examiner* — Cephia D Toomer
(74) *Attorney, Agent, or Firm* — Lippes Mathias LLP

(57) ABSTRACT

A calcium sulfonate grease is formed from a base oil of lubricating viscosity, an oil-soluble overbased calcium sulfonate or precursors therefor, a conversion acid, water, and a gelling agent, which is selected from branched aliphatic diols with at least eight carbons, and mixtures thereof.

20 Claims, No Drawings

GELLING AGENT FOR CALCIUM SULFONATE GREASES

This application claims the priority of International Application PCT/IB2023/058207, filed Aug. 15, 2023, and U.S. Provisional Application 63/402,994, filed Sep. 1, 2022, from which the PCT application claims priority, the disclosures of which are incorporated herein in their entireties by reference.

FIELD OF THE INVENTION

The invention relates generally to lubricating greases and finds particular application in connection with a calcium sulfonate grease prepared using a gelling agent which includes at least one aliphatic $C_8$ or higher diol, such as 2-ethyl-1,3-hexanediol, and to a process of preparing the grease, and to a lubricating method.

BACKGROUND

Gelled calcium sulfonate greases are typically prepared by mixing an overbased calcium sulfonate detergent with a base oil. The mixture is treated with an acid to destabilize the micellular structure, followed by addition of a gelling agent and water. Over a period of several hours, at a suitable gelation temperature, amorphous calcium carbonate in the mixture is converted to crystalline calcite and a viscous grease forms.

The gelling agent is generally a hydroxyl source, such as an alcohol or glycol, which facilitates the conversion of the overbased detergent amorphous calcium carbonate into a calcium sulfonate grease with calcite.

The process is described more fully in the following references:

U.S. Pat. No. 3,242,079 issued, entitled BASIC METAL-CONTAINING THICKENED OIL COMPOSITIONS, by McMillen, describes a homogeneous grease composition prepared by mixing a fluid mineral oil solution containing a sulfonic acid salt or carboxylic acid salt, and an active hydrogen compound selected from lower aliphatic carboxylic acids, water, and water-alcohol mixtures.

U.S. Pat. No. 3,714,042, issued Jan. 30, 1973, entitled TREATED OVERBASED COMPLEXES, by Greenough, describes treating overbased complexes with high molecular weight aliphatic carboxylic acids, anhydrides, esters, amides, imides, or salts. The treated overbased complexes may be used as additives in lubricating oils, gasolines, and other organic materials.

U.S. Pat. No. 5,126,062, issued Jun. 30, 1992, entitled CALCIUM SULFONATE GREASE AND METHOD OF MANUFACTURE, by Barnes, describes an overbased calcium sulfonate complex grease including a neutral oil, calcium sulfonate, calcium carbonate, dodecyl benzyl sulfonic acid, isopropyl alcohol, water, calcium hydroxide, 12-hydroxystearic acid, phosphoric acid, and an antioxidant.

U.S. Pat. No. 5,308,514, issued May 3, 1994, entitled SULFONATE GREASES, by Olson, et al., and U.S. Pat. No. 5,338,467, issued Aug. 16, 1994, entitled SULFONATE GREASE IMPROVEMENT, by Olson, et al., describe greases including an overbased calcium sulfonate and solid particles of colloidally dispersed calcium carbonate in the form of calcite which formed by heating overbased calcium sulfonate, amorphous calcium carbonate, and a fatty acid of twelve to twenty-four carbon atoms in an oil.

One problem with existing gelling agents is that the process of conversion of amorphous calcium carbonate to crystalline calcite is often slow. Additionally, since the gelling agent is typically removed at the end of the gelling process by vaporization, it is desirable for it to have a low toxicity in the event of release into the environment.

There remains a need for a gelling agent that provides a rapid conversion while being safe in use.

BRIEF DESCRIPTION

In accordance with one aspect of the exemplary embodiment, a calcium sulfonate grease is formed from a base oil of lubricating viscosity, an oil-soluble overbased calcium sulfonate or precursors therefor, a conversion acid, and a gelling agent. The gelling agent is selected from branched aliphatic diols with at least eight carbons, and mixtures thereof.

In the calcium sulfonate grease, the gelling agent may be selected from branched aliphatic diols with eight to ten carbons.

The gelling agent may be selected from branched aliphatic diols with eight carbons, branched aliphatic diols with nine carbons, and mixtures thereof, such as branched aliphatic diols with eight carbons.

The gelling agent may include at least one of 2-ethyl-1,3-hexanediol, 2-butyl-2-ethyl-propanediol, and 2,5-dimethyl-2,5-hexanediol.

The gelling agent may be at least 0.5 wt. %, or at least 1 wt. %, or up to 5 wt. %, or up to 3 wt. %, of a total weight of the base oil, the oil-soluble overbased calcium sulfonate or precursors therefor, the conversion acid, and the gelling agent.

The gelling agent may include or consist essentially of 2-ethyl-1,3-hexanediol.

The 2-ethyl-1,3-hexanediol may be at least 0.5 wt. %, or at least 1 wt. %, of a total weight of the base oil, the oil-soluble overbased calcium sulfonate or precursors therefor, the conversion acid, and the gelling agent.

The conversion acid may be selected from an alkylbenzene sulfonic acid with an aliphatic chain of from 8 to 36 carbon atoms, a succinic acid with an aliphatic chain of from 8 to36 carbon atoms, a succinic acid with an alkyl or alkenyl group on the C2 or C3 of the succinic acid and with an aliphatic chain of from 8 to 36 carbon atoms, and mixtures thereof.

The conversion acid may be at least 1 wt. %, or at least 3 wt. %, or at least 4 wt. %, or up to 15 wt. %, or up to 12 wt. % of a total weight of the base oil, the oil-soluble overbased calcium sulfonate or precursors therefor, the conversion acid, and the gelling agent.

The oil-soluble overbased calcium sulfonate may have a total base number (TBN) of at least 300, or at least 350, or up to 600, or up to 500 mg KOH/g eq, as measured according to ASTM D2896.

The oil-soluble overbased calcium sulfonate may be a calcium salt of a sulfonic acid selected from alkyl sulfonic acids, aryl sulfonic acids, alkyl aryl sulfonic acids and mixtures thereof.

The oil-soluble overbased calcium sulfonate may include or consist of a calcium salt of a sulfonic acid having at least 10, or at least 12, or at least 20 aliphatic carbon atoms, or up to 36, or up to 30, or up to 24 aliphatic carbon atoms.

The oil-soluble overbased calcium sulfonate may include a calcium salt of a sulfonic acid selected from dodecylbenzene sulfonic acid, didodecylbenzene sulfonic acid, dinonylbenzene sulfonic acid, dinonyl substituted naphthalene sulfonic acid, mahogany acid, mono-wax (eicosane)-substituted naphthalene sulfonic acid, octadecyl-diphenyl ether sulfonic acid, octadecyl-diphenyl amine sulfonic acid, cetyl-chlorobenzene sulfonic acid, dilauryl beta-naphthalene sulfonic acid, a sulfonic acid derived by the treatment of polyisobutylene with chloro sulfonic acid, nitro naphthalene sulfonic acid, paraffin wax sulfonic acid, cetyl-cyclopentane sulfonic acid, lauryl cyclohexane sulfonic acid, polyethylene sulfonic acid, and mixtures thereof.

The oil-soluble overbased calcium sulfonate may include or consist of a synthetic calcium salt of an alkylbenzene sulfonic acid which includes at least one C8-C36 alkyl group, or at least one C8-C24 alkyl group.

The oil-soluble overbased calcium sulfonate may include calcium carbonate.

The oil-soluble overbased calcium sulfonate may be at least 3 wt. %, or at least 5 wt. %, or at least 8 wt. %, or up to 25 wt. %, or up to 20 wt. %, or up to 15 wt. % of a total weight of the base oil, the oil-soluble overbased calcium sulfonate or precursors therefor, the conversion acid, and the gelling agent.

The base oil may be at least 40 wt. %, or at least 50 wt. %, or at least 60 wt. %, or up to 90 wt. %, or up to 80 wt. % of a total weight of the base oil, the oil-soluble overbased calcium sulfonate or precursors therefor, the conversion acid, and the gelling agent.

The calcium sulfonate grease may be further formed from water.

The water may be added at 2-25 parts by weight, or up to 15 parts by weight, based on a total weight of the base oil, the oil-soluble overbased calcium sulfonate or precursors therefor, the conversion acid, and the gelling agent.

The calcium sulfonate grease may be a calcium sulfonate complex grease which is further prepared from at least one of a complexing agent and a saponification agent.

The complexing agent may be selected from a long chain carboxylic acid or calcium salt thereof, a short chain carboxylic acid or calcium salt thereof, boric acid, salts thereof, and organic boron compounds, phosphoric acid, sulfonic acid and mixtures thereof.

The complexing agent may be at least 0.5 wt. %, or at least 1 wt. %, or at least 2 wt. %, or up to 12 wt. %, or up to 10 wt. % of a total weight of the complex grease.

The saponification agent may be selected from calcium oxide, calcium hydroxide, calcium carbonate, and mixtures thereof.

The saponification agent may be at least 0.5 wt. %, or at least 1 wt. %, or at least 2 wt. %, or up to 10 wt. %, or up to 6 wt. % of a total weight of the complex grease.

The calcium sulfonate grease may further include at least one performance additive selected from an antioxidant, an antiwear agent, an extreme pressure agent, a friction modifier, a viscosity modifier, a metal deactivator and/or corrosion inhibitor, and mixtures thereof.

The at least one performance additive, in total, may be at least 0.01 wt. %, or at least 0.1 wt. %, or up to 10 wt. %, or up to 5 wt. %, or up to 3 wt. % of the calcium sulfonate grease.

In accordance with another aspect of the exemplary embodiment, a method of forming a calcium sulfonate grease includes combining a base oil of lubricating viscosity, an oil-soluble overbased calcium sulfonate or precursors therefor, a conversion acid, a gelling agent, and water to form a mixture, wherein the gelling agent is selected from branched aliphatic diols with at least eight carbons, and mixtures thereof; and heating the mixture to a gelation temperature at which the mixture forms a gel.

In the method, the mixture may be an emulsion and may be formed at a temperature of less than 30° C.

The method may further include incorporating at least one of a complexing agent and a saponification agent into the gel to form a calcium sulfonate complex grease.

In accordance with another aspect of the exemplary embodiment, a formulation for forming a calcium sulfonate grease includes 3-20 wt. % of an overbased calcium sulfonate; 1-12 wt. % of a conversion acid; 0.5-6 wt. % of a gelling agent; 2-25 wt. % of water; and at least 30 wt. % of a base oil.

DETAILED DESCRIPTION

Aspects of the exemplary embodiment relate to a calcium sulfonate grease prepared using a gelling agent which includes at least one branched aliphatic diol with at least eight carbons.

In one embodiment, the gelling agent includes or consists of 2-ethyl-1,3-hexanediol.

The calcium sulfonate grease may be prepared from (1) a base oil of lubricating viscosity, (2) an oil-soluble overbased calcium sulfonate, or precursors for forming an overbased calcium sulfonate, such as a calcium sulfonate and a source of calcium carbonate, (3) a conversion acid, (4) a gelling agent, and (5) water.

Additional components may be used to form the calcium sulfonate grease. For preparing a calcium sulfonate complex grease, rather than a simple calcium sulfonate grease, components (1) to (5) plus (6) a complexing agent, and optionally (7) a saponification agent, may be employed. One or more performance additives may be incorporated into the calcium sulfonate grease.

A process for making a simple calcium sulfonate grease may include mixing a prepared overbased calcium sulfonate with the base oil, and the conversion acid to destabilize the micellular structure of the calcium carbonate in the overbased calcium sulfonate. The exemplary gelling agent and the water are added, and the resulting emulsion is heated to its gelation temperature. The amorphous calcium carbonate is converted to crystalline calcite, generally within 1 hour. Removal of the water and gelling agent from the mixture results in a gelled calcium sulfonate grease. Performance additives may be incorporated in the grease. Other methods of preparing the simple calcium sulfonate grease which employ the exemplary gelling agent are also contemplated.

A process for making a calcium sulfonate complex grease may include combining a base oil with calcium sulfonate overbased with calcium carbonate, an acid, a gelling agent, and water, as described for the simple calcium sulfonate grease, followed by addition of the complexing acid and optionally a calcium source. Performance additives may be incorporated in the grease. Some advantages of calcium sulfonate complex greases over the simple greases include reduced tackiness, improved pumpability, and improved high temperature utility.

A method of lubricating a mechanical device may include applying the calcium sulfonate simple grease or calcium sulfonate complex grease to the mechanical device.

1. The Base Oil of Lubricating Viscosity

The grease may include the base oil as a minor or major component thereof, such as at least 5 wt. %, or at least 10 wt. %, or at least 20 wt. %, or at least 30 wt. %, or at least 40 wt. %, or at least 60 wt. %, or at least 80 wt. %, or up to 94 wt. % of the grease.

In forming the grease, the base oil may be at least 30 wt. %, or at least 40 wt. %, or at least 50 wt. %, or at least 60 wt. %, or up to 95 wt. %, or up to 90 wt. %, or up to 80 wt. % of a combined weight of the base oil, the oil-soluble overbased calcium sulfonate or precursors therefor, the conversion acid, and the gelling agent (i.e., components (1)-(4)).

Suitable base oils include natural and synthetic oils, oil derived from hydrocracking, hydrogenation, and hydrofinishing, unrefined, refined, re-refined oils or mixtures thereof. Unrefined, refined and re-refined oils, and natural and synthetic oils are described, for example, in WO2008/147704 and US Pub. No. 2010/197536. Synthetic oils may also be produced by Fischer-Tropsch reactions and typically may be hydroisomerized Fischer-Tropsch hydrocarbons or waxes. Oils may be prepared by a Fischer-Tropsch gas-to-liquid synthetic procedure as well as other gas-to-liquid procedures.

Oils of lubricating viscosity may also be defined as specified in April 2008 version of "Appendix E-API Base Oil Interchangeability Guidelines for Passenger Car Motor Oils and Diesel Engine Oils", section 1.3 Sub-heading 1.3. "Base Stock Categories". The API Guidelines are also summarized in U.S. Pat. No. 7,285,516. The five base oil groups are as follows: Group I (sulfur content >0.03 wt. %, and/or <90 wt. % saturates, viscosity index 80-120); Group II (sulfur content <0.03 wt. %, and >90 wt. % saturates, viscosity index 80-120); Group III (sulfur content <0.03 wt. %, and >90 wt. % saturates, viscosity index >120); Group IV (all polyalphaolefins (PAOs)); and Group V (all others not included in Groups I, II, III, or IV). The exemplary oil of lubricating viscosity includes an API Group I, Group II, Group III, Group IV, Group V oil, or mixtures thereof. In some embodiments, the oil of lubricating viscosity is an API Group I, Group II, Group III, or Group IV oil, or mixtures thereof. In some embodiments, the oil of lubricating viscosity is an API Group I, Group II, or Group III oil, or mixture thereof. In one embodiment the oil of lubricating viscosity may be an API Group II, Group III mineral oil, a Group IV synthetic oil, or mixture thereof.

A kinematic viscosity (KV40) of the base oil may be 100-650 cSt, such as about 110 cSt, or about 500 cSt. Viscosity (KV40) is determined at 40° C. according to ASTM D445-21e1, "Standard Test Method for Kinematic Viscosity of Transparent and Opaque Liquids (and Calculation of Dynamic Viscosity)." Viscosity (KV100) is kinematic viscosity determined at 100° C. according to ASTM D445.

In one embodiment, the base oil for forming the grease includes one or more mineral oils. Example mineral oils useful herein include API Group I base oils, Group II paraffinic mineral oils, and mixtures thereof. One example Group I base oil is designated 150 Brightstock (150BS), which has a viscosity (KV40) of 461-597 cSt. Another suitable base oil is Americas CORE™ 2500, available from ExxonMobil Corporation, which has a KV100 of 30.6-32.7 cSt. However, other natural and synthetic base oils are also contemplated.

2. The Oil-Soluble Calcium Sulfonate

The calcium sulfonate is a salt of calcium with a long chain sulfonic acid. The calcium sulfonate may have a molecular weight of at least 400. The calcium sulfonate may be overbased. By "overbased" it is meant that the calcium is in excess of stoichiometric amounts with respect to the sulfonate counterion. The overbased calcium sulfonate may have a metal:sulfonate ratio of at least 3:1, or at least 4:1, or at least 6:1.

A suitable overbased calcium sulfonate may have a total base number (TBN) of at least 300, or at least 350, or up to 600, or up to 500 mg KOH/g eq. As used herein, TBN is measured according to ASTM D2896-21, "Standard Test Method for Base Number of Petroleum Products by Potentiometric Perchloric Acid Titration".

Example sulfonic acids for forming the calcium sulfonate include alkyl (including cycloalkyl), aryl, and alkyl aryl sulfonic acids, where the aryl group may be benzene, toluene, naphthalene, or the like. The sulfonic acid may contain at least 10, or at least 12, or at least 20 aliphatic carbon atoms in the molecule, and/or up to 36, or up to 30, or up to 24 aliphatic carbon atoms in the molecule, e.g., in one or two alkyl chains and/or a cyclic alkyl. Examples include petroleum sulfonic acids or acids obtained by treating an alkylated aromatic hydrocarbon with a sulfonating agent, e.g., chlorosulfonic acid, sulfur trioxide, oleum, sulfuric acid, or sulfur dioxide and chlorine. The sulfonic acids obtained by sulfonating an alkylated benzene, alkylated naphthalene, alkylated toluene, alkylated phenol, alkylated phenol sulfide, or alkylated diphenyl oxide are especially useful.

In one embodiment, the sulfonic acid is a synthetic sulfonic acid, which allows the alkyl chain length to be controlled to a reasonable degree. In another embodiment, the sulfonic acid is derived from petroleum distillates, which may have a broader range of alkyl chain lengths.

Specific examples of sulfonic acids include dodecylbenzene sulfonic acid, didodecylbenzene sulfonic acid, dinonylbenzene sulfonic acid, dinonyl substituted naphthalene sulfonic acid, mahogany acid (mixtures of sulfonic acid derivatives of petroleum that are obtained as by-products in refining white oils with sulfuric acid or made as primary products by sulfonation of petroleum distillates), mono-wax (eicosane)-substituted naphthalene sulfonic acid, octadecyl-diphenyl ether sulfonic acid, octadecyl-diphenyl amine sulfonic acid, cetyl-chlorobenzene sulfonic acid, dilauryl beta-naphthalene sulfonic acid, a sulfonic acid derived by the treatment of polyisobutylene having a molecular weight of about 1500 with chloro sulfonic acid, nitro naphthalene sulfonic acid, paraffin wax sulfonic acid, cetyl-cyclopentane sulfonic acid, lauryl cyclohexane sulfonic acid, polyethylene sulfonic acid, and mixtures thereof.

In one specific embodiment, the sulfonic acid salt is a synthetic calcium salt of an alkylbenzene sulfonic acid which includes at least one $C_8$-$C_{36}$ alkyl group. Linear alkyl benzenes may have the benzene ring attached anywhere on the linear chain, usually at the 2, 3, or 4 position, or be mixtures thereof. The alkylbenzene sulfonate may be a branched alkylbenzene sulfonate, a linear alkylbenzene sulfonate, or mixtures thereof. Non-limiting examples include dodecylbenzene sulfonic acid, didodecylbenzene sulfonic acid, dinonylbenzene sulfonic acid, and mixtures thereof.

In another specific embodiment, the sulfonic acid salt is petroleum derived mahogany or green sulfonate as described in U.S. Pat. No. 3,242,079.

The calcium sulfonate may be overbased with calcium carbonate by combining the calcium sulfonate with the calcium carbonate or precursor(s) therefor, in a sufficient amount to provide an overbased calcium sulfonate with a total base number (TBN) of at least 300, or at least 350, or up to 600, or up to 500, such as about 400 (on an oil free basis).

Commercially available overbased calcium sulfonate detergents of this type include the following: HiTEC 611™, from Afton Chemical, Hybase C401, from Chemtura USA Corporation, Syncal OB 400 and Syncal OB405-WO, from Kimes Technologies International Corporation, and Lubrizol 5358, a 400 TBN detergent, from Lubrizol. Other examples of 400 TBN overbased calcium sulfonate detergents include 75GR, 75NS, 75P, 75WO, 5347 and 5347LC products from Lubrizol, CSQL-400S, QLS 207, and QLS 207WO products from Quimico Liposolubles SA de CV, MX3240 SN500 and MX3240 WO from ENI. Examples of 300 TBN overbased calcium sulfonate detergents include 5342 and 6478A products from Lubrizol and QLS 206 from Quimico Liposolubles SA. Generally, these commercial products are a mixture of calcium sulfonate, calcium carbonate, and lime in a suitable oil.

In one embodiment, to form the overbased calcium sulfonate, calcium oxide and/or hydroxide is combined with the calcium sulfonate, and optionally an oil, which may be the same as the base oil. Carbon dioxide is bubbled through the reaction mixture, thereby incorporating an excess of calcium carbonate into the calcium sulfonate which confers reserve alkalinity to the overbased calcium sulfonate.

The calcium carbonate in the overbased calcium sulfonate detergent may have a maximum particle size of less than 20 micrometers and a quartz content of less than about 0.05 wt. %.

In forming the grease, the oil-soluble overbased calcium sulfonate may be at least 3 wt. %, or at least 5 wt. %, or at least 8 wt. %, or up to 25 wt. %, or up to 20 wt. %, or up to 15 wt. % of a total weight of the base oil, the oil-soluble overbased calcium sulfonate or precursors therefor, the conversion acid, and the gelling agent (i.e., components (1)-(4)).

In one embodiment, the overbased calcium sulfonate (or precursors) may be at least 2 wt. % by weight, or at least 4 wt. %, or up 15 wt. %, or up 8 wt. % of the total weight of all components used to form the grease.

3. The Conversion Acid

The conversion acid used for conversion of the calcium carbonate to calcite may be selected from an alkylbenzene sulfonic acid with an aliphatic chain of between 8 and 36 carbon atoms, a succinic acid with an aliphatic chain of between 8 and 36 carbon atoms, a succinic acid with an alkyl or alkenyl group on the C2 or C3 of the succinic acid with an aliphatic chain of between 8 and 36 carbon atoms, succinic acid, benzoic acid, and mixtures thereof.

The conversion acid, as measured on an oil-free basis, may be at least 0.5% by weight of the total weight of components used to form the grease (including components (1)-(5) and optionally (6) and (7), where the grease is a complex grease). In forming the grease, the conversion acid may be at least 1 wt. %, or at least 3 wt. %, or at least 4 wt. % or up to 15 wt. %, or up to 12 wt. % of a total weight of the base oil, the oil-soluble overbased calcium sulfonate or precursors therefor, the conversion acid, and the gelling agent (i.e., components (1)-(4)).

The amount of the conversion acid used in the grease formulation may be dependent, in part, on the strength of the acid and also on the amount of hydrated lime in the formulation.

4. The Gelling Agent

The gelling agent serves as a source of OH groups, in addition to any water present. The gelling agent facilitates conversion of the amorphous calcium carbonate to very finely divided crystalline calcium carbonate. The gelling agent includes a branched aliphatic diol with at least eight carbons, such as a C8-C10 diol, or a C8-C9 diol, or a mixture thereof, in particular, a C8 diol. Particularly suitable diols are those which are capable of converting at least 90 wt. %, or at least 95 wt. %, or at least 98 wt. % of the amorphous calcium carbonate present in the grease formulation, at the time the gelling agent is added, to calcite in under 1 hour, such as within 45 minutes or less, at the gelation temperature (e.g., in the range of 89-94° C.), in particular, when used with a strong conversion acid, such as a linear or branched alkylbenzene sulfonic acid with an aliphatic chain of between 8 and 36 carbon atoms.

In one embodiment, the branched aliphatic diol includes no ether groups. In one embodiment, the branched aliphatic diol consists solely of the elements carbon, hydrogen, and oxygen. In one embodiment, the diol includes only two OH groups. The two OH groups may be separated by a chain of up to three carbon atoms.

In one embodiment, the gelling agent includes or consists of at least one diol selected from 2-ethyl-1,3-hexanediol, 2,5-dimethyl-2,5-hexanediol, and 2-butyl-2-ethyl-propanediol, or a combination thereof. In one embodiment, a ratio, by weight of 2-ethyl-1,3-hexanediol to the total of all other diols used as gelling agents may be at least 1:1, or at least 2:1, or at least 3:1, or at least 5:1, or at least 10:1. The gelling agent may consist of 2-ethyl-1,3-hexanediol or consist essentially of 2-ethyl-1,3-hexanediol (at least 95 wt. % or at least 98 wt. % of the gelling aid is 2-ethyl-1,3-hexanediol).

The gelling agent may be at least 0.5% by weight of the total weight of components used to form the grease (including components (1)-(5) and optionally (6) and (7), where the grease is a complex grease). In forming the grease, the gelling agent may be at least 0.5 wt. %, or at least 1 wt. %, or up to 5 wt. %, or up to 3 wt. %, of a total weight of the base oil, the oil-soluble overbased calcium sulfonate or precursors therefor, the conversion acid, and the gelling agent (i.e., components (1)-(4)).

5. Water

The water is present in a sufficient amount to allow the conversion to take place. This may depend, in part, on the type of reactor used to form the grease. In a substantially closed reactor, water from the reaction which evaporates condenses on the surface of the reactor and is returned to the reaction. In contrast, in an open reactor, more water may be needed to account for evaporated water which is not recaptured.

Water may be present at 3 wt. % or more of the total weight of components used to form the grease (including components (1)-(5) and optionally (6) and (7), where the grease is a complex grease). In one embodiment, in forming the grease, the water may be added at 2-25 parts by weight, based on a total weight of the base oil, the oil-soluble overbased calcium sulfonate or precursors therefor, the conversion acid, and the gelling agent. Any unreacted water is substantially evaporated in forming the grease and thus water is not present in the finished grease in any significant amount, e.g., at 1 wt. %, or less.

6. The Complexing Agent

To form a complex grease, the grease formulation may further include one or more complexing agents, such as a complexing acid and/or a salt thereof. The complexing acid(s) may be selected from a long chain carboxylic acid or calcium salt thereof, a short chain carboxylic acid or calcium salt thereof, boric acid, boric acid salts, organic boron compounds, phosphoric acid, sulfonic acid, and mixtures thereof. Long chain carboxylic acids suitable for use include aliphatic carboxylic acids with 12-24 carbon atoms, such as least 16 carbon atoms, and include 12-hydroxystearic acid (12-HSA) and oleic acid. Short chain carboxylic acids suitable for use include aliphatic carboxylic acids with no more than 8 carbon atoms, or no more than 4 atoms, such as acetic acid. Suitable calcium salts of carboxylic acids include a calcium salt of a hydrogenated castor oil, a calcium salt of acetic acid, and mixtures thereof. Suitable borated organic compounds include borated amines, borated amides, borated esters, borated alcohols, borated glycols, borated ethers, borated epoxides, borated ureas, borated carboxylic acids, borated sulfonic acids, borated expoxides, borated peroxides, and mixtures thereof.

Suitable sulfonic acids include alkyl benzene sulfonic acids, having an alkyl chain length of 1 to 20 carbons. In one embodiment, the alkyl benzene sulfonic acid includes a mixture of alkyl chain lengths of from 10-16 carbons in length. In one embodiment, the benzene sulfonic acid includes dodecylbenzene sulfonic acid ("DDBSA"). Commercially available benzene sulfonic acids of this type include JemPak™ 1298 Sulfonic Acid, from by JemPak GK Inc., Calsoft™ LAS-99, from Pilot Chemical Company, and Biosoft™ S-101, from Stepan Chemical Company.

The complexing agent(s) may be present at from 0.3 wt. % to 15 wt. %, based on the final weight of the grease. In some embodiments, the complexing agent is at least 0.5 wt. %, or at least 1 wt. %, or at least 2 wt. %, or up to 12 wt. %, or up to 10 wt. %, or up to 5 wt. % of a total weight of the components used to form the complex grease. In another embodiment, short chain carboxylic acids are present at from 0.5 wt. % to 2 wt. %, based on the final weight of the complex grease.

7. Saponification Agent

Where the complexing agent is an acid rather than a salt, a strong calcium base, such as at least one of calcium oxide and calcium hydroxide, and/or calcium carbonate, may be present in the grease formulation, e.g., in the form of hydrated lime.

The saponification agent may be added in sufficient amount to form a complex soap structure. In particular, the saponification agent may be present at from 0.5 wt. % to 8 wt. %, based on the final weight of the complex grease. In one embodiment, the saponification agent may be at least 0.5 wt. %, or at least 1 wt. %, or at least 2 wt. %, or up to 10 wt. %, or up to 6 wt. % of a total weight of the components used to form the complex grease.

8. Performance Additives

One or more performance additives may be incorporated into the grease. These may include at least one of an antioxidant, an antiwear agent, an extreme pressure agent, a friction modifier, a viscosity modifier (which may include a dispersant viscosity modifier), a metal deactivator and/or corrosion inhibitor, and mixtures thereof. The fully-formulated grease composition may contain one or more of these performance additives. Some of the performance additives may provide two or more of these functions.

Performance additives, other than the components of the grease composition described in (1) to (7), where employed, may be at least 0.01 wt. %, or at least 0.1 wt. %, or up to 10 wt. %, or up to 5 wt. %, or up to 3 wt. % of the grease.

(a) Antioxidants

Antioxidants may include, for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. A single antioxidant or a combination of two or more can be used.

Hindered phenol antioxidants may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In an embodiment the hindered phenol antioxidant may be an ester and may include, e.g., an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms.

Other useful antioxidants may include diarylamines and high molecular weight phenols. In an embodiment, the grease composition may contain a mixture of a diarylamine and a high molecular weight phenol, such that each antioxidant may be present in an amount sufficient to provide up to about 5%, by weight of the antioxidant, based upon the final weight of the grease composition. In some embodiments, the antioxidant may be a mixture of about 0.3 to about 1.5% diarylamine and about 0.4 to about 2.5% high molecular weight phenol, by weight, based upon the final weight of the grease composition.

Examples of suitable olefins that may be sulfurized to form a sulfurized olefin include propylene, butylene, isobutylene, polyisobutylene, pentene, hexene, heptene, octene, nonene, decene, undecene, dodecene, tridecene, tetradecene, pentadecene, hexadecene, heptadecene, octadecene, nonadecene, eicosene or mixtures thereof. In an embodiment, hexadecene, heptadecene, octadecene, nonadecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulfurized olefin includes sulfurized fatty acids and their esters. The fatty acids are often obtained from vegetable oil or animal oil and typically contain about 4 to about 22 carbon atoms. Examples of suitable fatty acids and their esters include triglycerides, oleic acid, linoleic acid, palmitoleic acid or mixtures thereof. The fatty acids may be obtained from lard oil, tall oil, peanut oil, soybean oil, cottonseed oil, sunflower seed oil or mixtures thereof. Fatty acids and/or esters may be mixed with olefins, such as alpha-olefins.

The one or more antioxidant(s), when present, may be, in total, at least 0.01 wt. %, or at least 0.1 wt. %, or at least 1 wt. %, or up to 10 wt. %, or up to 5 wt. %, of the grease composition.

(b) Antiwear Agents

Examples of suitable antiwear agents include a metal thiophosphate, a metal dialkyldithiophosphate, a phosphoric acid ester or salt thereof; a phosphate ester(s); a phosphite; a phosphorus-containing carboxylic ester, ether, or amide; a sulfurized olefin, thiocarbamate-containing compounds including, thiocarbamate esters, alkylene-coupled thiocarbamates, and bis(S-alkyldithiocarbamyl)disulfides, and mixtures thereof. Phosphorus containing antiwear agents include dialkyl dithiophosphate salts of an alkali metal, alkaline earth metal, aluminum, lead, tin, molybdenum, manganese, nickel, copper, titanium, or zinc. A useful antiwear agent may be a thiophosphate such as zinc dialkyldithiophosphate.

The one or more antiwear agent(s), when present, may be, in total, at least 0.01 wt. %, or at least 0.1 wt. %, or at least 0.5 wt. %, or up to 10 wt. %, or up to 5 wt. %, or up to 3 wt. %, of the grease composition.

(c) Extreme Pressure Agents

Extreme Pressure (EP) agents that are soluble in the base oil include sulfur- and chlorosulfur-containing EP agents, chlorinated hydrocarbon EP agents and phosphorus EP agents. Examples of such EP agents include chlorinated waxes; organic sulfides and polysulfides such as dibenzyldisulfide, bis(chlorobenzyl) disulfide, dibutyl tetrasulfide, sulfurized methyl ester of oleic acid, sulfurized alkylphenol, sulfurized dipentene, sulfurized terpene, and sulfurized Diels-Alder adducts; phosphosulfurized hydrocarbons, such as the reaction product of phosphorus sulfide with turpentine or methyl oleate; phosphorus esters such as the dihydrocarbyl and trihydrocarbyl phosphites, e.g., dibutyl phosphite, diheptyl phosphite, dicyclohexyl phosphite, pentylphenyl phosphite, dipentylphenyl phosphite, tridecyl phosphite, distearyl phosphite and polypropylene substituted phenyl phosphite; metal thiocarbamates, such as zinc dioctyldithiocarbamate and barium heptylphenol diacid; amine salts of alkyl and dialkylphosphoric acids, such as the amine salt of the reaction product of a dialkyldithiophosphoric acid with propylene oxide; and mixtures thereof.

The one or more extreme pressure agent(s), when present, may be, in total, at least 0.01 wt. %, or at least 0.1 wt. %, or at least 0.5 wt. %, or up to 10 wt. %, or up to 5 wt. %, or up to 3 wt. %, of the grease composition.

(d) Friction Modifiers

Suitable friction modifiers include metal containing and metal-free friction modifiers.

In one embodiment, the friction modifier may be an ash-free friction modifier. Such friction modifiers are those which typically not produce any sulfated ash when subjected to the conditions of ASTM D 874-13a (2018), "Standard Test Method for Sulfated Ash from Lubricating Oils and Additives." Example friction modifiers may include imidazolines, amides, amines, succinimides, alkoxylated amines, alkoxylated ether amines, amine oxides, amidoamines, nitriles, betaines, quaternary amines, imines, amine salts, amino guanidines, alkanolamides, phosphonates, metal-containing compounds, glycerol esters, sulfurized fatty compounds and olefins, sunflower oil and other naturally occurring plant or animal oils, dicarboxylic acid esters, esters or partial esters of a polyol and one or more aliphatic or aromatic carboxylic acids, and mixtures thereof.

Suitable friction modifiers may contain hydrocarbyl groups that are selected from straight chain, branched chain, or aromatic hydrocarbyl groups or mixtures thereof, and may be saturated or unsaturated. The hydrocarbyl groups may be composed of carbon and hydrogen or hetero atoms such as sulfur or oxygen. The hydrocarbyl groups may range from about 12 to about 25 carbon atoms. In a embodiments the friction modifier may be a long chain fatty acid ester. In an embodiment the long chain fatty acid ester may be a mono-ester, or a di-ester, or a (tri)glyceride. The friction modifier may be a long chain fatty amide, a long chain fatty ester, a long chain fatty epoxide derivative, or a long chain imidazoline.

Other suitable friction modifiers include organic, ashless (metal-free), nitrogen-free organic friction modifiers. Such friction modifiers may include esters formed by reacting carboxylic acids and anhydrides with alkanols and generally include a polar terminal group (e.g., carboxyl or hydroxyl) covalently bonded to an oleophilic hydrocarbon chain. An example of an organic ashless nitrogen-free friction modifier is glycerol monooleate (GMO) which may contain mono-, di-, and tri-esters of oleic acid.

Aminic friction modifiers may include amines or polyamines. Such compounds can have aliphatic groups that are linear, either saturated or unsaturated, or a mixture thereof and may contain from 8 to 30 carbon atoms. Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate.

The one or more friction modifier(s), when present, may be, in total, at least 0.01 wt. %, or at least 0.1 wt. %, or at least 0.5 wt. %, or up to 10 wt. %, or up to 5 wt. %, or up to 4 wt. %, of the grease composition.

(e) Viscosity Modifiers

Suitable viscosity modifiers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, and mixtures thereof. Viscosity modifiers may include star polymers, e.g., as described in US Pub. No. 2012/0101017 A1.

The grease composition may additionally or alternatively include one or more dispersant viscosity modifiers. Suitable dispersant viscosity modifiers include functionalized polyolefins, for example, ethylene-propylene copolymers that have been functionalized with the reaction product of an acylating agent (such as maleic anhydride) and an amine; polymethacrylates functionalized with an amine; esterified maleic anhydride-styrene copolymers reacted with an amine, and mixtures thereof.

The one or more viscosity modifier(s), when present, may be, in total, at least 0.01 wt. %, or at least 0.1 wt. %, or at least 0.5 wt. %, or up to 10 wt. %, or up to 5 wt. %, or up to 3 wt. %, of the grease composition.

(f) Corrosion Inhibitors and Metal Deactivators

Corrosion inhibitors/metal deactivators that may be useful in the exemplary lubricating composition include fatty amines, octylamine octanoate, condensation products of dodecenyl succinic acid or anhydride, and a fatty acid such as oleic acid with a polyamine, derivatives of benzotriazoles (e.g., tolyltriazole), 1,2,4-triazoles, benzimidazoles, 2-alkyldithiobenzimidazoles and 2-alkyldithiobenzothiazoles.

The one or more corrosion inhibitors/metal deactivators, when present, may be, in total, at least 0.001 wt. %, or at least 0.01 wt. %, or at least 0.1 wt. %, or up to 10 wt. %, or up to 5 wt. %, or up to 3 wt. %, of the grease composition.

Other Additives

The grease formulation may include minor amounts of other additives, e.g., as present in commercial overbased calcium sulfonates, such as alcohol and/or other processing aids.

Methods of Preparation of the Calcium Sulfonate Grease

In one embodiment, a two-step process is used for preparing the overbased calcium sulfonate. In a first step ("promotion") a stoichiometric excess amount of calcium oxide (CaO) or calcium hydroxide ($Ca(OH)_2$), as a base source is combined with an alkylbenzene sulfonic acid, carbon dioxide ($CO_2$), and optionally with other components to produce an oil-soluble overbased calcium sulfonate with amorphous calcium carbonate dispersed therein. In a second step ("conversion") the gelling agent and water are added to the product of the promotion step, along with a suitable base oil (such as mineral oil), to convert the amorphous calcium carbonate to a very finely divided dispersion of crystalline calcium carbonate, also known as a colloidal dispersion, that interacts with the calcium sulfonate to form a grease-like consistency. Such overbased calcium sulfonate greases produced through the two-step process may be referred to as "simple calcium sulfonate greases."

In another embodiment, a single step process combines the promoting and conversion steps into a single step by carefully controlling the reaction. In this one-step process, the simple calcium sulfonate grease is prepared by reaction of the sulfonic acid with either calcium hydroxide or calcium oxide in the presence of carbon dioxide and a system of reagents that simultaneously act as both promoter (creating the amorphous calcium carbonate overbasing by reaction of carbon dioxide with an excess amount of calcium oxide or calcium hydroxide) and the gelling agent (converting the amorphous calcium carbonate to very finely divided crystalline calcium carbonate). Thus, the grease-like consistency is formed in a single step wherein the overbased, oil-soluble calcium sulfonate (the product of the first step in the two-step process) is never actually formed and isolated as a separate product. One-step processes are disclosed, for example, in U.S. Pat. Nos. 3,661,622, 3,671,012, 3,746,643, and 3,816,310.

In another embodiment, a calcium sulfonate grease is prepared with a preformed oil-soluble overbased calcium sulfonate. In this embodiment the base oil is combined with the oil-soluble overbased calcium sulfonate, acid (e.g., an alkylbenzene sulfonic acid), the gelling agent, and water and these are mixed together at a low temperature (below 30° C., e.g., 18-23° C.) until an emulsion is formed, followed by heating to a gelation temperature (e.g., in the range of 89-94° C.) where the temperature is maintained until substantial or complete conversion of amorphous calcium carbonate to calcite occurs. Forming an emulsion at a low temperature helps to avoid loss of water when the mixture is heated.

In another embodiment, a calcium sulfonate complex grease is prepared by adding a saponification agent, e.g., a strong calcium-containing base, such as calcium hydroxide or calcium oxide (e.g., as hydrated lime), to the simple calcium sulfonate grease produced by any of the processes described above, and reacting the simple grease with a stoichiometrically equivalent amount of one or more complexing acids, such as 12-hydroxystearic acid (12-HSA), boric acid, acetic acid, and/or phosphoric acid, and optionally adding additional base oil. Further details on the preparation of calcium sulfonate complex greases are disclosed, for example, in U.S. Pat. Nos. 4,560,489, 5,126,062, 5,308,514, and 5,338,467.

The grease preparation method may be carried out in an open or closed kettle, as is commonly used for grease manufacturing. The process can be achieved at normal atmospheric pressure although it can be carried out under pressure in a closed kettle. In one embodiment, the method is carried out in an open kettle.

Example Grease Formulations

Table 1 illustrates examples of simple sulfonic acid grease formulations (exclusive of any performance additives, processing agents, and solvents, other than those listed), where components are expressed as wt. % of the grease formulation. Table 2 illustrates examples of complex sulfonic acid grease formulations.

TABLE 1

Example Simple Grease Formulations

| Component | Ex. A | Ex. B | Ex. C |
|---|---|---|---|
| Overbased calcium sulfonate (or calcium sulfonate and a source of calcium carbonate) | 3-20 | 5-15 | 7-13 |
| Water | 2-25 | 5-15 | 7-12 |
| Conversion acid (e.g., an alkylbenzene sulfonic acid or a succinic acid) | 1-12 | 3-8 | 4-6 |
| Gelling agent (branched $C_8$-$C_9$ diol, e.g., 2-ethyl-1,3-hexanediol) | 0.5-6 | 1-4 | 2-3 |
| Base oil | (balance to 100 wt. %) | (balance to 100 wt. %) | (balance to 100 wt. %) |
| Ratio of Ca sulfonate to Ca carbonate sources in the overbased Ca sulfonate | 1:3 to 1:1.5 | 1:2.5 to 1:1.8 | 1:2.3-1:2.0 |

TABLE 2

Complex Grease Formulations

| Component | Ex. D | Ex. E | Ex. F |
|---|---|---|---|
| Overbased calcium sulfonate (or calcium sulfonate and a source of calcium carbonate) | 1-12 | 2-10 | 3-8 |

TABLE 2-continued

| Complex Grease Formulations | | | |
|---|---|---|---|
| Component | Ex. D | Ex. E | Ex. F |
| Water | 2-28 | 5-25 | 6-22 |
| Conversion acid (e.g., an alkylbenzene sulfonic acid or a succinic acid) | 1-10 | 2-8 | 2-6 |
| Gelling agent ($C_8$-$C_9$ diol, e.g., 2-ethyl-1,3-hexanediol) | 0.3-5.0 | 0.6-3.0 | 0.7-2.0 |
| Complexing agent (acid or salt thereof, e.g., acetic acid, boric acid, 12-hydroxystearic acid) | 0.5-10.0 | 1.0-8.0 | 2.0-7.0 |
| Saponification agent (e.g., calcium oxide/hydroxide) | 0.5-5.0 | 1-5.0 | 1.5-4.0 |
| Base oil | (balance to 100 wt. %) | (balance to 100 wt. %) | (balance to 100 wt. %) |
| Ratio of Ca sulfonate to Ca carbonate sources in the overbased Ca sulfonate | 1:3 to 1:1.5 | 1:2.5 to 1:1.8 | 1:2.3-1:2.0 |

Properties of the Sulfonic Acid Grease

In one embodiment, the grease may have the consistency of common greases as classified by the National Lubricating Grease Institute (NLGI). Common greases have NLGI grades of 1-3, corresponding to a cone penetration of 230 to 340, as measured by ASTM D217-21a, "Standard Test Methods for Cone Penetration of Lubricating Grease". In certain embodiments, the grease is a complex grease with a cone penetration of 230 to 340, as measured by ASTM D217-21a. In other embodiments, the complex grease has a cone penetration of from 265 to 295 as measured by ASTM D217-21a.

By addition of extra oil, if needed, the complex greases prepared from the simple greases can have comparable penetration scores, e.g., within NLGI grades 1-3, and in certain embodiments in NLGI grade 2 or 3. In some embodiments, at least 90 or 95 wt. % of the amorphous calcium carbonate present in the grease formulation is converted and the grease formulation is in NLGI grade 2 or 3.

The dropping point of a lubricating grease is an indication of the static heat resistance of the grease and is the temperature at which it may pass from a semi-solid to a liquid state, or bleed excessive amounts of oil, under specific test conditions. The dropping point indicates the upper temperature limit at which a grease retains its structure though is not necessarily the maximum temperature at which a grease can be used. In one embodiment, the complex grease has a dropping point of from 260° C. to 304° C. (or above), as measured by ASTM D2265-22, "Standard Test Method for Dropping Point of Lubricating Grease Over Wide Temperature Range."

The composition of greases can be characterized by Fourier Transform Infrared (FTIR) spectroscopy. In one embodiment, the infrared spectrum of the exemplary simple grease shows a peak at about 883 $cm^{-1}$, demonstrating the presence of the calcite allotrope of $CaCO_3$. For conversion of less than 100%, in particular, at below 95%, a second peak is observed at around 864 $cm^{-1}$, corresponding to residual amorphous calcium carbonate. A percentage conversion can be estimated as the area under the peak at about 883 $cm^{-1}$ divided by this area plus the area under the peak at about 864 $cm^{-1}$, multiplied by 100.

The presence of a peak at about 1569 $cm^{-1}$ in a complex grease is characteristic of a carbonyl peak and demonstrates incorporation of calcium acetate into the grease structure with relative intensity of the peaks corresponding to relative calcium acetate content of the batch.

The calcium sulfonate greases described herein do not readily separate oil or suffer breakdown under shear and so tend to have no issues with ASTM D2265-22 Dropping Point Test, the ASTM D217-21a, "Standard Test Methods for Cone Penetration of Lubricating Grease," test, the oil separation test ASTM D1742-20, or wheel bearing leakage test ASTM D4290-20. The extreme pressure and antiwear requirements are also met by the greases, with 4-ball weld loads as measured by ASTM D2596-20 over 315 kg and 4-ball wear scars <0.4 mm as measured by ASTM D2266-01 (2015). Synthetic sulfonate greases can be formulated to pass the ASTM D1743-22 corrosion test, and water washout is typically less than 5%, which is well below the 15% limit as required by the standard. Provided that suitable base oils are used, there is typically no issue with passing the ASTM D4693-07 (2021) low temperature torque test.

Applications

The calcium sulfonate greases described herein find application as an a High-performance Multipurpose (HPM) grease and as a High Load Carrying (HPM+HL) grease, as defined by the NLGI. The greases also find use in applications that require high temperature and good load carrying capacity, such as in steel mill applications, heavy-duty industrial machinery, mining, and in food manufacturing.

Without intending to limit the scope of the exemplary embodiment, the following examples illustrate exemplary grease compositions and comparative examples which indicate the benefits obtained employing the illustrative gelling agent. All amounts, unless indicated otherwise, are on an oil free basis and are by weight.

EXAMPLES

The following materials were obtained:

- A 400 TBN synthetic overbased calcium sulfonate, 75GR, obtained from Lubrizol. This material includes 20 wt. % calcium sulfonate, 35 wt. % calcium carbonate, 2-3 wt. % lime, 40 wt. % oil, and trace amounts (a total of 2-3 wt. %) of alcohol, water, and a processing aid.
- A 600N API Group II paraffinic mineral oil with a KV40 of 110 cSt, obtained from Chevron.
- A BS150 Group I base oil with a KV40 of 500 cSt, obtained from Holly Frontier under the trade name Sunpar™.
- A mixed $C_{10}$ to $C_{16}$ alkylbenzene sulfonic acid ("ABSA"), sold as Biosoft™ S-101, obtained from Stepan Chemical Company.
- 2-ethyl-1,3-hexanediol, and other OH sources, obtained from Gulf Chemical Inc.
- 12-hydroxystearic acid, obtained from Acme Hardesty.
- Acetic Acid, obtained from Brenntag.
- Boric Acid, obtained from US Borax.
- An Alkylated diphenyl amine, GR9510, obtained from The Lubrizol Corporation.
- Water.

Example 1

Calcium sulfonate compositions (some of which resulted in simple greases) were prepared as follows:

To a 1.5 liter stainless steel open reactor with a heater and wall scraping paddle at room temperature (~20° C.), 65.0 wt.

% of Lubrizol 75GR (containing 55 wt. % 400TBN synthetic overbased oil soluble calcium sulfonate), 27.5 wt. % 600N API Group II paraffinic mineral oil with a KV40=110 cSt (base oil), 5.0 wt. % of an alkyl benzene sulfonic acid (ABSA), and 2.5 wt. % of the candidate gelling agent are added. To this, 10 wt. % of water is added. The contents of the reactor are mixed until an emulsion forms. The mixture is then heated to 90° C. and held until the material has gelled, or for 2 hours, whichever is the longer. The extent of conversion is confirmed by FTIR spectroscopy. The majority of the water and candidate gelling agent are stripped by heating the mixture to 150° C., holding for 30 minutes and then allowing the mixture to cool. The consistency (penetration grade) is determined and the dropping point measured.

Conversion of the amorphous calcium carbonate to a crystalline form (primarily calcite) is estimated from the FTIR spectrum. The amorphous calcium carbonate has a broad band at around 864 $cm^{-1}$. As the conversion progresses, this broad band shrinks and a sharp peak appears in the spectrum at about 883 $cm^{-1}$. When there is 100% conversion, there is no amorphous band and only a single large peak is observed in the spectrum at about 883 $cm^{-1}$. To determine the % conversion, the area under each peak (864 $cm^{-1}$ and 883 $cm^{-1}$) is estimated and ratioed.

Results are shown in Table 3.

Under the NLGI Grading System, a Worked Penetration Range (determined according to ASTM D217-21a) of 355 to 385 is grade 0, 310 to 340 is grade 1, 265 to 295 is grade 2, and 220 to 250 is grade 3.

TABLE 3

| OH Source | Conversion %, time | Observation | NLGI Grade |
|---|---|---|---|
| Control (no OH source) | 0 | Liquid | — |
| 2-Ethyl-1,3-hexanediol | 100%, 45 min. | Thick | 2 |
| 2-Methyl-2,4-Pentanediol | 90%, 1 hr | Thick | 2 |
| 2-Butyl-2-Ethyl-Propanediol | 100%, 30 min. | Very thick | 2 |
| 2,5-Dimethyl-2,5-Hexanediol | 90%, 1 hr | Very thick | 3 |
| 1,2-Octanediol | 60%, 2 hrs | very thin | 0 |
| 1,2-Hexanediol | 85%, 2 hrs | Thin gel | 1 |
| 1,6-Hexanediol | 0%, 2 hrs | Liquid | 0 |
| Diethylene Glycol Mono Butyl Ether | 80%, 1 hr | Thick gel | 2 |
| Diethylene Glycol Mono Methyl Ether | 0%, 1 hr | Liquid | — |
| Dodecyl Alcohol | 0%, 2 hrs | Liquid | — |
| 2(2-Ethylhexyloxy) Ethanol | 0%, 2 hrs | Liquid | — |
| 2-Methyl-1,3-Butanediol | 80%, 1 hr | Gel | 2 |
| Methoxy Polyethylene Glycol | 0%, 2 hrs | Liquid | — |

Based on the results, 2-ethyl-1,3-hexanediol, 2-butyl-2-ethyl-propanediol, and 2,5-dimethyl-2,5-hexanediol exhibit a complete conversion in under one hour to a form a thick gel. These branched 8-carbon diols perform better, as gel forming agents, than the comparative unbranched diols.

Example 2

Calcium sulfonate complex greases are prepared as follows:

Example 2A

To a reactor, 418 g of Lubrizol 75GR (20 wt. % 400 TBN synthetic overbased calcium sulfonate) followed by 108.4 g of Group II 600N base oil, and 108.4 g of BS150 base oil, are added. The mixture is heated to 50° C. 11.5 g glacial acetic acid is mixed with 100 g water and added. 9.9 g of 2-ethyl-1,3-hexanediol is added and 37 g alkylbenzene sulfonic acid added slowly. The temperature is ramped up to 90° C. and held for 1 hour or until FTIR indicates complete conversion. The FTIR spectrum is captured.

After conversion, complexation is carried out. A further 108.4 g of base oil and 108.4 g of BS150 oil are added, followed by 30.2 g of hydrated lime, 25.2 g of boric acid, and 100 g of water. The mixture is mixed for 30 min for proper incorporation. The temperature is raised to 140-150° C. for 1 hour to dehydrate. Once dehydration is complete, 34.2 g of 12-hydroxystearic acid is added. After 0.5 hours, the mixture is cooled to 80° C. Once the mixture is at 80° C., 5 g of Lubrizol GR9510 antioxidant (alkylated diphenyl amine) is added. The grease is homogenized using a three roller mill and the penetration and dropping point of the grease are checked. If the grease is too stiff, additional oil is added and mixed. This is repeated until the grease is within the desired NLGI grade.

Comparative Example 2B

The method for Example 2A is repeated, except that 9.9 g diethylene glycol butyl ether is used in place of the 2-ethyl-1,3-hexanediol.

Table 4 shows the two formulations.

TABLE 4

Complex Grease formulations

| Component | Ex. 2A, Weight percent | Ex. 2B, Weight percent |
|---|---|---|
| Lubrizol 75GR, containing a synthetic overbased calcium sulfonate | 41.8 (equivalent to 8.4 wt. % calcium sulfonate, 14.6 wt. % calcium carbonate, 16.7 wt. % oil and 0.8 wt. % lime) | 41.8 (equivalent to 8.4 wt. % calcium sulfonate, 14.6 wt. % calcium carbonate, 16.7 wt. % oil and 0.8 wt. % lime) |
| Group II 600N base oil | 10.84 | 10.84 |
| 150 Bright Stock base oil | 10.84 | 10.84 |
| Alkylbenzene sulfonic acid | 3.7 | 3.7 |
| Water (Not included in Final %) | 20 | 20 |
| Acetic Acid | 1.15 | 1.15 |
| 2-ethyl-1,3-hexanediol | 0.99 | |
| Diethylene glycol butyl ether | | 0.99 |
| Gelation total (excl. Water) | 69.32 | 69.32 |
| Group II 600N base oil | 10.84 | 10.84 |
| 150 Bright Stock base oil | 10.84 | 10.84 |
| Lime | 3.02 | 3.02 |
| Boric Acid | 2.52 | 2.52 |
| 12-Hydroxystearic acid | 3.42 | 3.42 |
| Lubrizol GR9510, Alkylated diphenyl amine | 0.5 | 0.5 |
| Total (excluding water) | 100 | 100% |

Table 5 shows the results obtained.

TABLE 5

Results

| Test | Description | Result: EX. 2A: 2-ethyl-1,3-hexanediol | Result: EX. 2B: diethylene glycol butyl ether |
|---|---|---|---|
| ASTM D2265-22 | Dropping Point | >304° C., Block 316° C. | >304° C., Block 316° C. |
| ASTM D217-21a | Unworked Cone Penetration (W0) | 229 | 205 |
| | Worked Cone Penetration (W60) | 233 | 233 |
| | Change | 4 | 28 |

Conversions are measured via FTIR. 2-ethyl-1,3-hexanediol has complete conversion while diethylene glycol butyl ether has, at best, 85% conversion at the end. Neither gelling aid showed a drop when measured according to ASTM D2265.

Diethylene glycol butyl ether shows a Worked 60 Cone Penetration change of 28, which is greater than typically expected (a change of <15 is normally considered acceptable).

Each of the documents referred to above is incorporated herein by reference in its entirety. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

We claim:

1. A calcium sulfonate grease formed from a base oil of lubricating viscosity, an oil-soluble overbased calcium sulfonate or precursors therefor, a conversion acid, and a gelling agent, which is selected from branched aliphatic diols with at least eight carbons and mixtures thereof.

2. The calcium sulfonate grease of claim 1, wherein the gelling agent is selected from branched aliphatic diols with eight to ten carbons.

3. The calcium sulfonate grease of claim 1, wherein the gelling agent is selected from branched aliphatic diols with eight carbons, branched aliphatic diols with nine carbons, and mixtures thereof.

4. The calcium sulfonate grease of claim 1, wherein the gelling agent comprises at least one of the group consisting of 2-ethyl-1,3-hexanediol, 2-butyl-2-ethyl-propanediol, 2,5-dimethyl-2,5-hexanediol, and combinations thereof.

5. The calcium sulfonate grease of claim 1, wherein the gelling agent is at least 0.5 wt. % of a total weight of the base oil, the oil-soluble overbased calcium sulfonate or precursors therefor, the conversion acid, and the gelling agent.

6. The calcium sulfonate grease of claim 1, wherein the oil-soluble overbased calcium sulfonate has a total base number (TBN) of at least 300 mg KOH/g eq, as measured according to ASTM D2896.

7. The calcium sulfonate grease of claim 1, wherein the oil-soluble overbased calcium sulfonate comprises a calcium salt of a sulfonic acid selected from alkyl sulfonic acids, aryl sulfonic acids, alkyl aryl sulfonic acids and mixtures thereof.

8. The calcium sulfonate grease of claim 1, wherein the oil-soluble overbased calcium sulfonate comprises a calcium salt of a sulfonic acid comprising at least 10 aliphatic carbon atoms.

9. The calcium sulfonate grease of claim 1, wherein the oil-soluble overbased calcium sulfonate is at least 3 wt. % of a total weight of the base oil, the oil-soluble overbased calcium sulfonate or precursors therefor, the conversion acid, and the gelling agent.

10. The calcium sulfonate grease of claim 1, wherein the conversion acid is selected from an alkylbenzene sulfonic acid with an aliphatic chain of between 8 and 36 carbon atoms, a succinic acid with an aliphatic chain of between 8 and 36 carbon atoms, a succinic acid with an alkyl or alkenyl group on the C2 or C3 of the succinic acid with an aliphatic chain of between 8 and 36 carbon atoms, and mixtures thereof.

11. The calcium sulfonate grease of claim 1, wherein the conversion acid is at least 1 wt. % of a total weight of the base oil, the oil-soluble overbased calcium sulfonate or precursors therefor, the conversion acid, and the gelling agent.

12. The calcium sulfonate grease of claim 1, wherein the base oil of lubricating viscosity is at least 40 wt. % of a total weight of the base oil, the oil-soluble overbased calcium sulfonate or precursors therefor, the conversion acid, and the gelling agent.

13. The calcium sulfonate grease of claim 1, wherein the calcium sulfonate grease is further formed from water, wherein the water is added at 2-25 parts by weight, based on a total weight of the base oil, the oil-soluble overbased calcium sulfonate or precursors therefore, the conversion acid, and the gelling agent.

14. The calcium sulfonate grease of claim 1, wherein the calcium sulfonate grease is a calcium sulfonate complex grease and wherein the calcium sulfonate complex grease is further prepared from at least one of a complexing agent and a saponification agent.

15. The calcium sulfonate complex grease of claim 14, wherein the complexing agent is selected from the group consisting of a long chain carboxylic acid or calcium salt thereof, a short chain carboxylic acid or calcium salt thereof, boric acid, salts thereof, and organic boron compounds, phosphoric acid, sulfonic acid and mixtures thereof.

16. The calcium sulfonate complex grease of claim 14, wherein the saponification agent is selected from the group consisting of calcium oxide calcium hydroxide, calcium carbonate, and mixtures thereof.

17. A method for lubricating a device comprising applying the calcium sulfonate grease of claim 1 to the device.

18. A method of forming a calcium sulfonate grease comprising:

combining a base oil of lubricating viscosity, an oil-soluble overbased calcium sulfonate or precursors therefor, a conversion acid, a gelling agent, and water to form a mixture, wherein the gelling agent is selected from branched aliphatic diols with at least eight carbons, and mixtures thereof; and heating the mixture to a gelation temperature at which the mixture forms a gel.

19. The method of claim 18, further comprising incorporating at least one of a complexing agent and a saponification agent into the gel to form a calcium sulfonate complex grease.

20. A formulation for forming a calcium sulfonate grease comprising:

3-20 wt. % of an overbased calcium sulfonate;

1-12 wt. % of a conversion acid;

2.5-6 wt. % of a gelling agent, which is selected from branched aliphatic diols with at least eight carbons and mixtures thereof;

2-25 wt. % of water; and at least 30 wt. % of a base oil.

* * * * *